US007867562B2

(12) United States Patent
Wisniewski et al.

(10) Patent No.: US 7,867,562 B2
(45) Date of Patent: Jan. 11, 2011

(54) METHOD OF CONTROLLING COATING EDGE THICKNESS IN A WEB PROCESS

(75) Inventors: Ronald S. Wisniewski, Mayflower, AR (US); Ming-Liang Shiao, Collegeville, PA (US); Harold F. Zimmerman, Little Rock, AR (US); Earnest E. McDaniel, Little Rock, AR (US); Gregory F. Jacobs, Oreland, PA (US); Keith C. Hong, Lititz, PA (US)

(73) Assignee: CertainTeed Corporation, Valley Forge, PA (US)

( * ) Notice: Subject to any disclaimer, the term of this patent is extended or adjusted under 35 U.S.C. 154(b) by 908 days.

(21) Appl. No.: 11/796,869

(22) Filed: Apr. 30, 2007

(65) Prior Publication Data

US 2008/0220167 A1 Sep. 11, 2008

(51) Int. Cl.
*B05D 5/00* (2006.01)
*B05D 3/12* (2006.01)

(52) U.S. Cl. ..... 427/256; 427/294; 427/355; 427/385.5; 118/325; 118/712

(58) Field of Classification Search ..... 427/256, 427/294, 355, 385.5; 118/325, 712
See application file for complete search history.

(56) References Cited

U.S. PATENT DOCUMENTS

| | | | | |
|---|---|---|---|---|
| 2,591,149 | A | 4/1952 | Grove | |
| 2,614,051 | A | 10/1952 | Buzzell et al. | |
| 2,898,232 | A | 8/1959 | Miller et al. | |
| 2,981,636 | A | 4/1961 | Lodge et al. | |
| 3,968,772 | A * | 7/1976 | Greiller | 118/325 |
| 4,117,798 | A | 10/1978 | Cornelius et al. | |
| 4,378,408 | A | 3/1983 | Joedicke | |
| 5,411,803 | A | 5/1995 | George et al. | |
| 5,683,514 | A * | 11/1997 | Cox et al. | 118/712 |
| 5,723,516 | A | 3/1998 | Bigham | |
| 5,843,522 | A | 12/1998 | Zanchetta et al. | |
| 5,950,387 | A | 9/1999 | Stahl et al. | |
| 6,143,318 | A | 11/2000 | Gilchrist et al. | |
| 6,426,309 | B1 | 7/2002 | Miller et al. | |
| 6,924,015 | B2 | 8/2005 | Zanchetta et al. | |
| 2004/0126923 | A1 * | 7/2004 | Benson | 438/58 |
| 2006/0196596 | A1 * | 9/2006 | Bartek et al. | 156/192 |

* cited by examiner

*Primary Examiner*—Duy-Vu N. Deo
*Assistant Examiner*—Mahmoud Dahimene
(74) *Attorney, Agent, or Firm*—Paul and Paul

(57) ABSTRACT

One method for controlling edge thickness includes applying a coating to a moving substrate, thereby forming a film having a cross direction and a machine direction and one or more edges. The method also includes modifying a thickness of a first portion of the coating along one of the edges of the film, thereby forming a film having a substantially predetermined profile in the cross direction. A method of making a polymeric sheet includes applying a polymer to a moving substrate, thereby forming a sheet having a cross direction and a machine direction. This method further includes removing a first portion of the polymer from a first edge of the sheet, thereby the sheet having a substantially predetermined profile in the cross direction.

27 Claims, 6 Drawing Sheets

METHOD OF CONTROLLING COATING EDGE THICKNESS IN A WEB PROCESS

BACKGROUND

The present exemplary embodiment relates to controlling edge thickness of an article of manufacturing. It finds particular application in conjunction with the manufacturing of coated sheets, and will be described with particular reference thereto. However, it is to be appreciated that the present exemplary embodiment is also amenable to other like applications.

Coatings may be applied to a moving substrate using application methods such as curtain coating, roller coating, flow coating, or spraying. During such processes, methods have been developed to create uncoated edges along the substrate. For example, a curtain coater may include a device called an interrupter cup which can be used to create an edge and also control the width of the uncoated area. In the case of a roofing membrane, such an uncoated area of a web process can form the "selvage edge".

As for coating asphalt shingles, the control and the formation of a predetermined edge is advantageous for applying the coating in certain areas of the shingle and not in other areas. For example, distinct portions of a coating may be applied on top of a layer of granules. In one embodiment, the coating may be a clear coat that is desired to be applied to that portion of the granules which will be visible once the shingles are applied to a roof. The clear coat having a well defined edge will assist with appearance of the shingle, as well as the overall roof appearance. The well defined edge will also reduce cost and increase productivity in the manufacturing of such shingles.

Unfortunately, a well-defined uniformly thick coating with a clean edge is difficult to achieve. Applicant has become aware that surface tension driven flow and edge evaporation effects will result in the formation of a thicker edge also known as a beading edge (picturing framing effect) on the film formed by the cured coating. The thicker coating along the edge of the coating creates coating curing issues due to the extra thickness of coating. Also, a beading edge on the final product can interfere with the normal use of the product. For example, the beading edge along the selvage edge of a roofing membrane can prevent good adhesion during the lapping process and it also has an aesthetically unacceptable appearance. As for asphalt shingles, a beading edge on the shingle can create high spots for water, dirt, or other contaminants to accumulate. The beading edge can also interfere with sealing the adjoining shingles. Furthermore, if the beading edge is exposed, it could very likely create appearance problems.

BRIEF DESCRIPTION

One method described herein includes a method of controlling coating edge thickness. The method may include applying a coating to a moving substrate, thereby forming a film having a cross direction and a machine direction and one or more edges. The method may also include modifying a thickness of a first portion of the coating along one of the edges of the film, thereby forming a film having a substantially predetermined profile in the cross direction.

Another method described herein includes applying a coating not quite substantially across a width of a moving substrate, such that the applied coating has a cross direction smaller than a cross direction of the substrate. The method may also include spreading at least a portion of the applied coating in the cross direction, the machine direction, or a combination thereof, of the coating such that the cross direction of the applied coating comprises a substantially predetermined profile.

A further method disclosed herein includes a method of making a polymeric sheet. The method includes the step of applying a polymer to a moving substrate, thereby forming a sheet having a cross direction and a machine direction. The method may further include removing a first portion of the polymer from a first edge of the sheet, thereby the sheet having a substantially predetermined profile in the cross direction.

DETAILED DESCRIPTION

Figure 1:
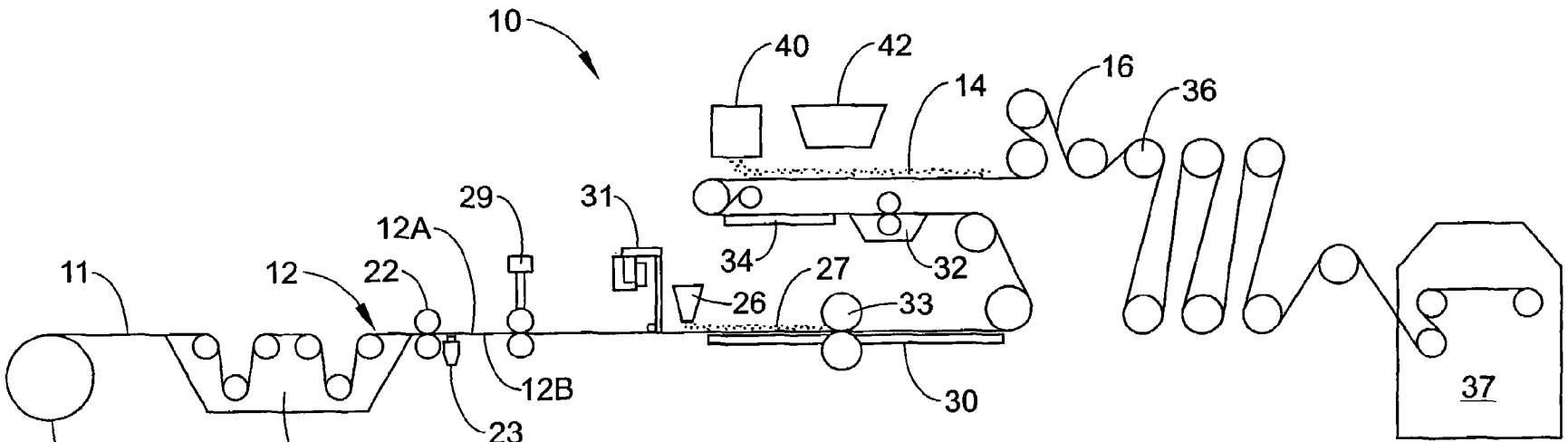
FIG. 1 is a side view of a coating operation in a roofing manufacturing process.

With respect to an exemplary embodiment, a side schematic representation of a coating operation is depicted. FIG. 1 schematically illustrates a preferred process 10 for preparing a substrate 12. The method described herein is applicable to various types of substrate 12 and is not limited to the production of any one particular end product. A non-limiting example of substrates and end products which the disclosed method may be applied to includes roofing substrates to make such end products such as shingles or roofing membranes. Examples of such shingles are described in U.S. Pat. Nos. 5,843,522, 6,426,309 and U.S. patent application granted Ser. No. 11/469,655 title Roofing Shingles with Enhanced Granule Adhesion and Method for Producing Same, all of which are incorporated herein by reference in their entirety. For particular examples of roofing membranes, though not an exhaustive list, the following U.S. patents and patent application are incorporated herein by reference in their entirety: U.S. Pat. Nos. 6,924,015, 5,843,522, and application granted the Ser. No. 11/380,327 filed on or about Apr. 26, 2006 titled Solar Heat Reflective Roofing Membrane and Process for Making the Same.

Further exemplary embodiments of substrate 12 may include a reinforcement carrier support 11 made from fabric such as polyester, fiberglass, and combinations thereof as a component of substrate 12. Examples of such carrier support 11 include but are not limited to WinterGuard™ shingle underlayment available from CertainTeed Corporation of Valley Forge, Penn. or asphalt-saturated roofing felts. One or more bituminous compositions may be applied to the carrier support 11. Examples of such compositions include modified bituminous coating material based on Atactic PolyPropylene (APP), Amorphous Poly Alpha Olefin (APAO), Thermoplastic PolyOlefin (TPO), Styrene-Butadiene-Styrene (SBS), Styrene-Ethylene-Butadiene-Styrene (SEBS), synthetic rubber, or other asphaltic modifiers, that will enhance the properties of asphalt. In one particular embodiment, substrate 12 may include a carrier support 11 that supports a dual compound modified asphalt, namely, an APP modified or SBS modified asphaltic compound, which is positioned on top of the carrier sheet, and a self-adhesive modified asphaltic compound, which is positioned below the carrier sheet. The adherent material serves to affix the membrane to the roof deck, base sheet or underlayment. Such self adhesives may include tackifiers such as Poly Vinyl Butyral (PVB) and pressure sensitive adhesives (PSA). Preferred PSAs are those based on silicones, rubber or acrylates. A Styrene-Isoprene-Styrene (SIS) rubber based adhesive is one example of a preferred PSA.

FIG. 1 illustrates a general overview of one type of process 10 for the manufacture of a dual compound modified bitumen composite substrate 12 which the disclosed methods may be incorporated into. One or more reinforcement carrier supports 11, which may be polyester, fiberglass, or a polyester/fiberglass combination, is unwound from a mat unwinding station 20, and saturated with the APP modified bitumen compound forming an upper layer 12A of substrate 12 in the saturation tank 21. Coating thickness is controlled using calender rolls 22 immediately after the saturated carrier support 11 comes out of the saturation tank 21. Optionally process 10 may include a scraper 23 which may be employed to scrape off the coating of tank 21 from the backside 12B of substrate 12. A self-adhesive compound may be subsequently applied to backside 12B of substrate 12 during a later stage in process 10.

As depicted process 10 may optionally further include an end lap adhesive applicator 29 to apply adhesive to an end lap section of substrate 12. Immediately following the application of the end lap adhesive coating, an end lap film may be applied to the corresponding sections using an end lap film applicator 31. Directly following these applications, surfacing agents 27 are applied using the surfacing applicator 26. After the surfacing application process, substrate 12 undergoes cooling by traveling on a chilled water bath 30 and over cooling drums and typically is cooled to about 95° C. If granules are applied as surfacing agents 27, substrate 12 is continued through the production line over granular press rollers 33 in order to imbed the granules into the hot bituminous compound of upper layer 12A. The process may also include a granule reclamation step to recover excess granules applied to substrate 12.

After traveling through a series of turns and gears optionally substrate 12 is inverted such that the upper-exposed surface 12A of the substrate 12 is now on the bottom side, and at about 160° C., a self-adhesive compound is applied to surface 12B at the coating vat 32. Following the self-adhesive application, the substrate 12 travels over a cooling belt to permit cooling of the self-adhesive compound. A release liner is applied to the self-adhesive using the release liner applicator 34. Then, the composite sheet travels through the accumulator 36 to the winder 37 where it is cut to the required length and wound into rolls. The methods disclosed herein are not limited to the afore described process, they also have applications to various other processes.

Preferably either prior to or subsequently to the application of the self adhesive to surface 12B of substrate 12, a coating composition may be applied to upper surface 12A of substrate 12. Various types of coating techniques may be used to apply the coating to upper surface 12A such as curtain coating with curtain coater 40. Alternatively, other methods of applying the coating composition to surface 12A such as brushing, roll coating, flow coating, spraying, electrostatic spray coating, or extrusion coating, depending upon the physical characteristics of the coating composition, can be employed.

As substrate 12 next passes under an infrared heater 42, the liquid coating composition on surface 12A is dried to form a continuous film 14 on the top of the surface 12A of substrate 12. Process 10 may include more than one (1) heater 42. Optionally, heaters 42 may be spaced apart. In the case where an extrusion coating process is employed using a thermoplastic polymer, heater 42 may optionally, be one or more cooling elements employed to bring the surface of the molten thermoplastic polymer to a substantially solid state. Optionally, then substrate 12 with film 14 coated on it passes through a second set of heated pressure rollers (not shown) which press film 14 into substrate 12 to form end product 16. End product 16 is taken up by the aforementioned accumulator 36 and winder 37.

In a further embodiment, the coating of coater 40 may be applied as an off-line process. In such an off-line process the aforementioned shingles or roofing membrane are manufactured in accordance with the general process shown in FIG. 1 without applying the coating. The coating would be applied in a subsequent operation. One exemplary embodiment of such an off-line operation may include at least an unwinding station, a coating station, a curing stage, an accumulator, and a winder. Like equipment may be the same as described in FIG. 1. Such that an exemplary coating station for the off-line process may include coater 40. The same is true for the unwinding stations (unwinding station 20) the curing station (heater 42), etc.

Figure 2:
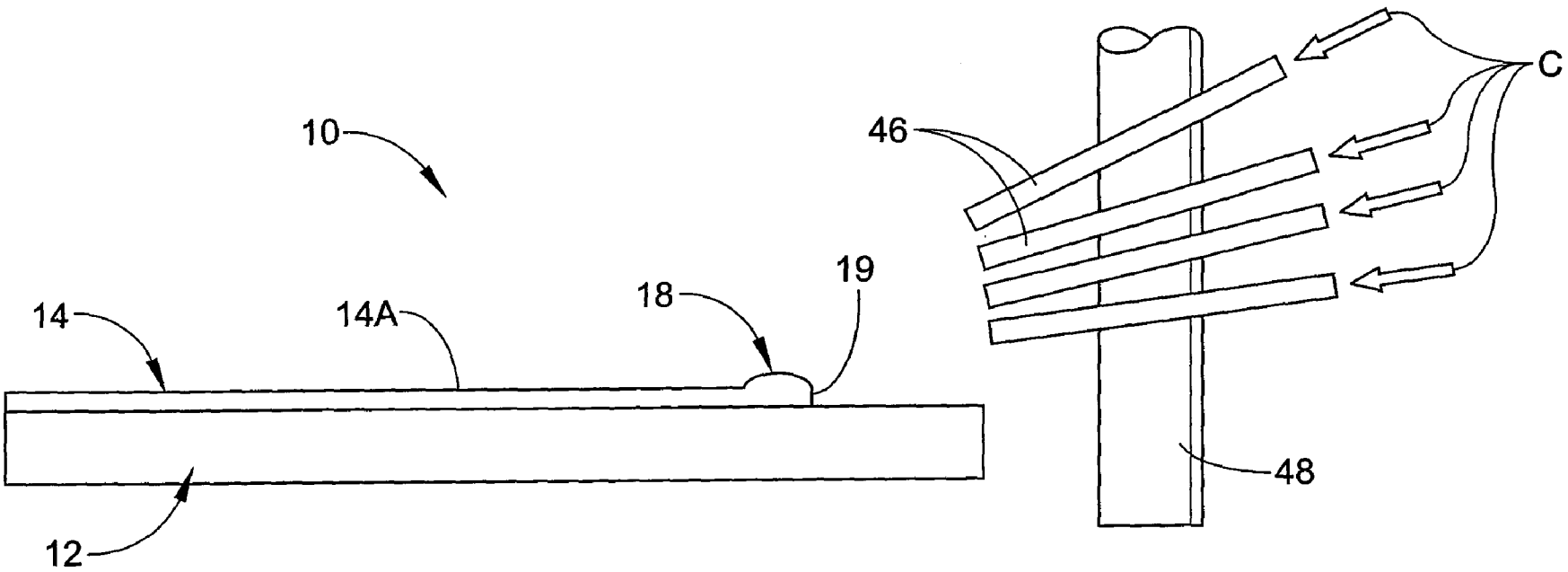
FIG. 2 is a cross-sectional view of a schematic diagram of an embodiment to control coating edge thickness disclosed herein.
Figure 5:
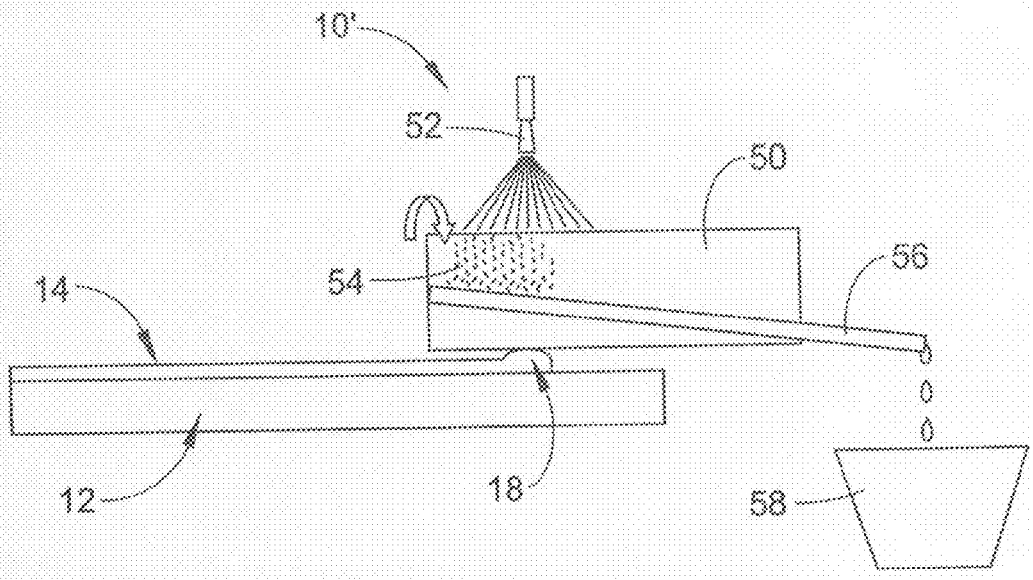
FIG. 5 is a cross-sectional view of a schematic diagram of a second embodiment for controlling coating edge thickness disclosed herein.
Figure 6:
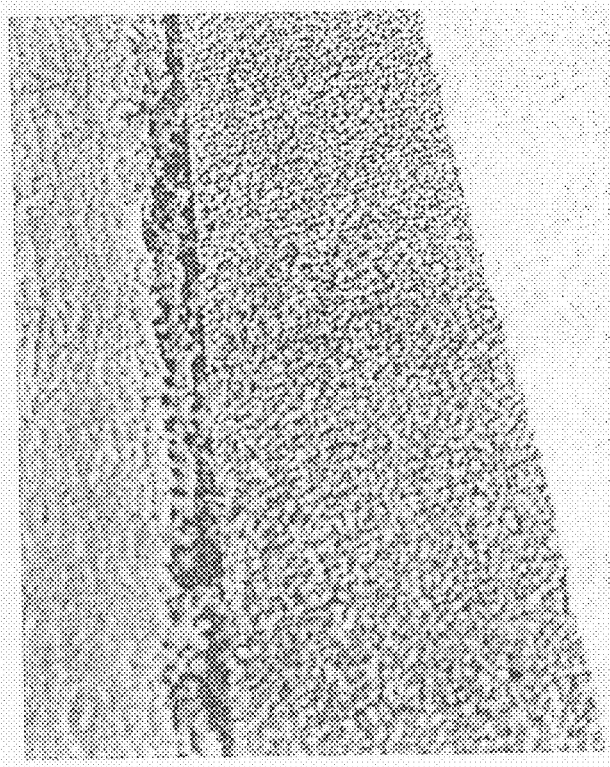
FIG. 6 is top view of a coated sheet before the method disclosed herein is applied to the sheet.

An embodiment of a coating method disclosed herein includes a method of controlling coating edge thickness. The method may include the step of applying a coating to moving substrate 12. The coating thereby forms film 14 having a cross direction and a machine direction on the substrate. Also film 14 has one or more edges, preferably at least two edges. The above method further includes modifying a thickness of a first portion of the coating along one edge of the film, thereby forming a film having a substantially predetermined profile in the cross direction as illustrated in FIGS. 2 and 5. In one embodiment, the predetermined profile may comprise a substantially uniform thickness of film 14 in its cross direction. The uniform thickness in the cross direction may be determined by viewing a portion of film 14 with the naked eye. If variations in thickness are not noticeable to an observer, then film 14 has a sufficiently uniform thickness. In another embodiment, the substantially predetermined profile in the cross direction comprises film 14 having one or more segments of thinner thickness than a remainder of the film 14. An example of the after embodiment is a film in which a portion of the film, including an edge of the film, is thinner in the cross direction than the rest of the film. Whether a portion is thinner than another portion may be determined by the aforementioned ordinary observer of the film. Alternatively, film 14 may include a second portion along a second edge of the film 14. A thickness of the second portion may be modified in the same manner as the first portion.

In one certain embodiment, the modifying the thickness of the first portion may be referred to as relocating an amount of the coating which makes up at least part of the first portion. The amount of the coating relocated may be moved in toward a section of the film that does not include the first portion. Alternatively, the amount of the coating may be taken away from the film.

In another certain embodiment, modifying may be referred to as removing an amount of the coating which makes up at least part of the first portion. Removing is used herein to mean at least all variations of removing the amount from its original location along the one edge of the film. By way of examples, removing may include taking away the amount from the film or moving the amount to a second area of the film that does not include the first portion.

From herein on in, the embodiments of the method described below will generally be referred to in terms of removing for ease of illustration, however, the afore terms of modifying and relocating are equally applicable to the embodiments. In one embodiment of the aforementioned method, the removing may comprise applying a non-mechanical force to the coating. In another embodiment, the removing may comprise applying a force to the coating which does not physically contact the coating, ("non-contacting force").

A further embodiment of the method may include partially curing the coating and the removing may include directing a fluid across at least a segment of a top surface of the partially cured coating of the film. Examples of a suitable fluid may include one selected from the group of nitrogen, air, helium, argon, neon, krypton, xenon, radon, carbon dioxide, any other gas substantially unreactive with the coating, and combinations thereof. The fluid may be directed across the top surface to move the portion toward a center of the film or alternatively, away from a center of the film.

The aforementioned methods will now be further described with respect to FIGS. 2-7. Illustrated in FIG. 2 is a portion of process 10 which includes moving substrate 12 moving in a direction out of the paper, toward the viewer. A film 14 is on the substrate 12. Film 14 is composed of the coating applied to substrate 12. As illustrated, film 14 may include a beaded edge 18 along one edge 19 of film 14. In an embodiment at this stage, the coating is still substantially in a liquid phase such that it is still mobile in order for it to be pushed back into the body of film 14 to give the controlled edge thickness.

The method is not limited to the application of any particular type of coating. Examples of particular types of coating include water borne coatings or solvent based coatings. The coating may be an emulsion type water borne coating. One example of such a coating may be a polymeric latex coating. The latex coating may include a polymeric material selected from the group consisting of polyethylene, polyolefins, acid-containing polyolefins, ethylene vinyl acetate, ethylene-alkyl acrylate copolymers, polyvinylbutyral, polyamides, fluoropolymers, acrylics, methacrylates, acrylates, polyurethane, and mixtures thereof. Alternatively, the coating may be a solvent based coating, a radiation curable coating, or a two part reactive coating. These alternative coatings may likewise include the above polymeric material.

Additionally, the coating applied may be pigmented or unpigmented. Also the coating may be a functionalized coating. Exemplary types of functionalization include antimicrobial, solar heat reflection, thermal stability, tack enhancer, UV protection, self cleaning, surface treatment (e.g., wetting agent) and combinations thereof. Particular functionalizing agents of interest include silicones, fluorine compounds (such as those disclosed in U.S. Pat. No. 6,933,101 incorporated herein by reference in its entirety), and antimicrobials. A specific example of the coating which may be used to form film 14 includes a reflective asphalt emulsion such as the one disclosed in U.S. Pat. No. 6,245,850 (incorporated herein by reference in its entirety). Preferred antimicrobials include algaecides such as various biocides. Examples of suitable biocides include hexahydro-1,3,5-tris(2-hydroxyethyl)-s-triazine, hexahydro-1,3,5-triethyl-s-triazine, 2-(tert-butylamino)-4-chloro-6-(ethylamino)-S-triazine, tetrahydro-3,5-dimethyl-2H-1,3,5-thiadiazine-2-thione, 3-iodo-2-propylbutyl carbamate, sodium dimethyldithiocarbamate, disodium ethylene bis-dithiocarbamate, disodium cyanodithioimidocarbamate, potassium N-methyidithiocarbamate, potassium dimethyldithiocarbamate, 2,2-dibromo-3-nitrilopropionamide, 2,2-dibromo-2-nitroethanol, 2-bromo-2-nitro-1,3-propanediol, 4,5-dichloro-2-n-octyl-4-isothiazolin-3-one, 2-methyl-2,3-dihydroisothiazol-3-one, 5-chloro-2-methyl-4-isothianzolin-3-one, 2-n-octyl-4-isothiazolin-3-one, chloroallyl-3,5,7-azoniaadamantane chloride, tetrakishydroxylmethyl phosphonium sulfate, poly [oxyethylene(dimethyliminio)ethylene-(dimethliminio)ethylene dichloride], didecyl dimethyl ammonium chloride, and dodecyl guanidine hydrochloride and mixtures thereof. A mixture of 2-n octyl-4-isothiazolin-3-one, methylbenzimidazole-2-yl-carbamate, and N'-(3,4 dichlorophenyl)-N-N-dimethylurea is one example of preferred algaecidal cocktails.

Examples of the solar heat reflection materials comprise mixed metal oxides (commercially available from Ferro Corp), aluminum oxides, nano-sized (20-150 nm particle size) metal oxides such as iron oxides, zinc oxide, titanium oxides, metal-coated silica flakes, silica-encapsulated metal flakes, metal-coated glass micro-spheres, lamellar effect pigments, nacreous pigments, diffractive pigment flakes, mirrorized fillers, glass beads, hollow microspheres, metals (such as silver and cooper), and combinations thereof.

One or more air knives 46 may be used to direct the fluid across at least a segment of a top surface 14A of film 14. As shown in one certain embodiment, process 10 may include four (4) air knives. Knives 46 may be operated separately or together. Also, the flow rate of the fluid through knives 46 may be the same, varied or a combination thereof. The pressure of the fluid exiting knives 46 may be the same, different, or a combination thereof. Also, air knives 46 may be supplied by the same or different fluid sources or combinations thereof. Lastly, as illustrated in FIG. 2, air knives 46 may be supported on a rack 48.

Figure 3:
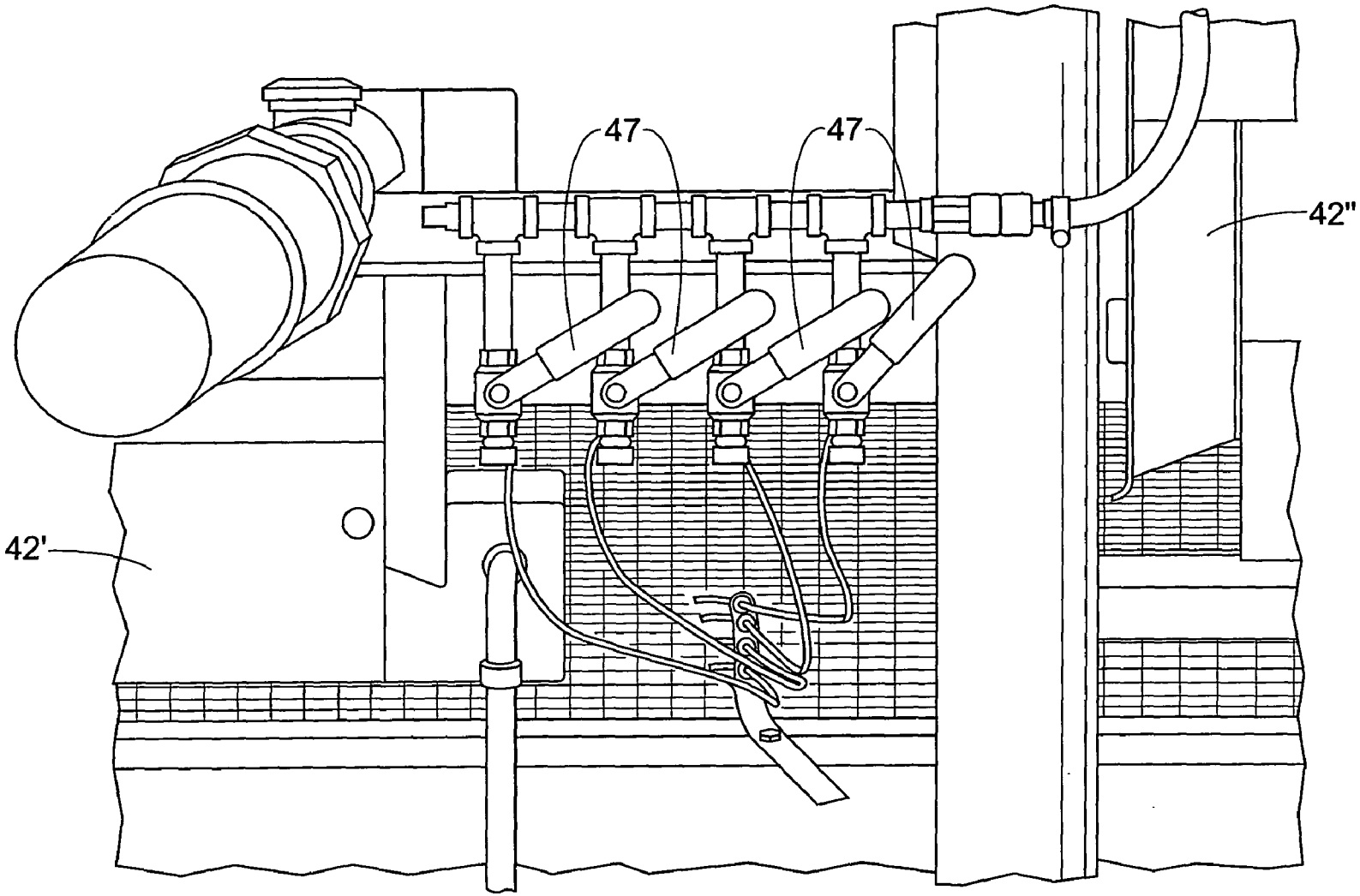
FIG. 3 is a rear view of the air knives illustrated in FIG. 2.
Figure 4:
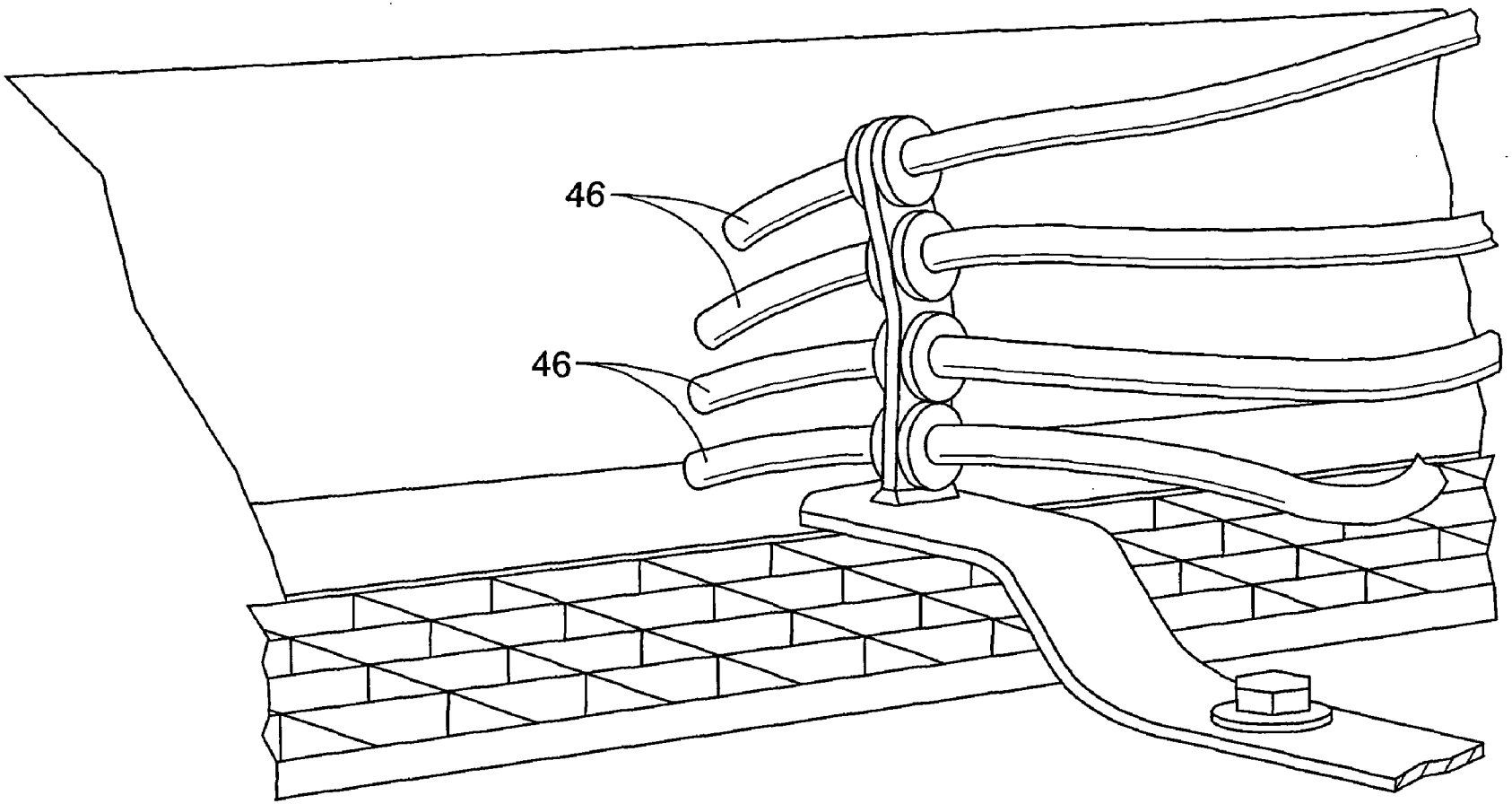
FIG. 4 is side view of another embodiment of the air knives which may be used to apply a positive or negative pressure to the film as described herein.

As shown in FIG. 3, the flow of fluid through the various knives 46 of process 10 may be individually applied. As shown, each knife 46 is equipped with a shut-off valve 47. As depicted in FIG. 4, various air knives 46 may be individually positioned to direct the fluid to distinct points along surface 14A. Also, the position of any particular knife 46 may be adjusted as determined appropriate.

The above method is not limited to the use of any particular number of air knives 46. Preferably a plurality of air knives 46 is used to achieve a multi-zone fluid flow and the flow patterns are adjustable, to enhance a user's ability to produce a film with a uniform appearance. Control of the flow of fluid can be manually adjusted, or alternatively, may be automated. It is further preferred that individual knives 46 may be independently controlled and adjusted for spreading bead edge 18 in the desired direction at the desired rate. The knives 46 may also be used to direct the fluid in a predetermined direction at a desired pressure to control the shape of bead edge 18.

Preferably, the methods described herein are used to produce a coating that has a uniform appearance. It is not streaky and is devoid of thin spots, discoloration spots and glossy spots.

Another further embodiment of the method may further comprise partially curing the coating and instead of directing a fluid across a top surface of the film, applying a negative pressure across at least a segment of a top surface of the film. In one certain embodiment, this may be accomplished by pulling a suitable vacuum across the film. The vacuum may be applied to move the portion of the film in the cross direction of the film either toward a center of the film or away from a center of the film. In an alternate embodiment, instead of applying a negative pressure, a positive pressure may be applied. Air knives 46 may be used to apply a positive pressure on film 14 when the fluid is directed through knives 46 in the direction of arrow C.

With respect to partially curing the coating, a technique for partially curing the coating is shown in FIG. 3. In FIG. 3, air knives 46 are located between two curing zones 42' and 42". As shown each curing zone is an IR heater. If thermal methods are used to cure the coating, any type of heating method may be used such as IR, induction, resistance, convection, microwave, etc. However, the above method is not limited by the mechanism used to cure the coating into film 14. Any type of curing technique may be used to cure the coating. Examples of a few types of suitable curing techniques include thermal techniques, radiation techniques, chemical techniques, and combinations thereof. As stated in the particular embodiment shown, air knives 46 are located between a first curing zone 42' and a second curing zone 42". The method is not limited by the use of any particular number of heating zones and the location of one or more air knives between any two of such heating zones.

Preferably the coating of film 14 and in particular bead 18 is partially cured to a state in which bead 18 may flow in a predetermined direction. Advantageously bead 18 is sufficiently cured that the fluid from knives 46 does not blow away the coating of film 14. In a certain embodiment, partially cured coating would not be considered runny. In one particular embodiment, the coating is not cured to a point at which the coating becomes tacky. In another particular embodiment, the coating is cured to a point at which the coating will exhibit an appropriate viscosity such that the coating will have a sufficient resistance to surface tension forces that segments of coating will not flow back to the edge of film 14 to from a subsequent beaded edge after the portion has been removed from edge 19.

In a further embodiment, the removing may comprise wicking up at least the portion of the coating along at least one edge of the film. Alternatively, this may further include applying a solvent to the portion of the coating wicked up. A non-exhaustive list of potentially suitable solvents includes water, hydrocarbons, aromatics, oxygenated solvents, and combinations thereof. Water is a preferred solvent for water borne coatings. The wicked up coating may optionally be recycled.

An embodiment of a device which may be used to wick up the portion of the coating is illustrated in FIG. 5 as 10'. As shown a wicking wheel 50 may be located in position to remove the portion of bead 18 from film 14. Optionally as described above a sprayer 52 may be used to apply solvent to the wicked up portion 54 of the coating of film 14. Preferably a suitable solvent is used to adjust the viscosity of portion 34 so that portion 54 will flow along transport element 56 into recycle tank 58. In a certain embodiment, sprayer 52 is used to maintain a proper solvent balance in portion 54 such that portion 54 may be recycled.

A further embodiment of the method may include removing the portion of the coating by adjusting a height of the portion of the coating such that the portion of the coating flows in the cross direction of the film. The portion may flow either toward the center of the film or away from a center of the film. The flow of the coating may be manipulated by incorporating height sensors and leveling devices into process 10. Another method of controlling coating edge thickness includes applying a coating not quite substantially across a width of a moving substrate, such that the applied coating has a cross direction smaller than a cross direction of substrate 12. The method may further include spreading at least a portion of the applied coating in the cross direction of the coating such that the cross direction of the applied coating comprises the afore described substantially predetermined profile. The spreading is not limited to any one particular technique. Techniques which may be used to spread the coating include the following, alone or in any combination thereof, blowing, gravity flow, scraping, etc. In one embodiment, the blowing includes applying a positive pressure to at least the portion of the applied coating. In another embodiment, the blowing comprises moving the portion of the coating toward a center of the applied coating. In a further embodiment, the blowing comprises moving the portion of the coating away from a center of the applied coating.

A particular embodiment the above described process may be automated. For example a thickness sensor may be incorporated into the process to determine if the thickness of the applied coating at a edge of the coating is within a predetermined range. If a controller in communication with the sensor determines, that the sensed portion of the coating is outside of the predetermined range, the controller may be used to activate one of the above described methods to control the thickness of the coating. For example with respect to the air knives, the controller may activate the air knives. Furthermore various levels of complexity may be incorporated into such an automated system. For example if the thickness of the coating is outside of the predetermined range by a value "X" the air knives may direct air at a first air pressure toward the coating. If the thickness of the coating is outside of the predetermined range by an amount of "X+Y", the air knives may direct air at a second air pressure, being greater than the first air pressure, toward the coating.

A further method disclosed herein may include a method of making a polymeric sheet. The method may include applying a polymer to a moving substrate, thereby forming a sheet having a cross direction and a machine direction. The method may also include removing a first portion of the polymer from a first edge of the sheet, thereby the sheet having a substantially predetermined thickness profile in the cross direction of the sheet.

This method may also include partially curing the polymer and wherein said removing includes directing a fluid across at least a segment of a top surface of the sheet. Alternatively, the method may further comprise partially curing the polymer and wherein the removing includes applying a negative pressure across at least a segment of a top surface of the sheet. Optionally, wherein the removing may include wicking up at least the first portion of the polymer along the first edge of the sheet.

The above processes may be used to control beading effects on the edge of a product so that the product may have a clean edge of a predetermined thickness suitable for the product to fulfill certain design functions.

An example of coating processes which the methods to control coating edge thickness disclosed herein may be applicable to include at least one selected from the group of curtain coating, roller coating, flow coating, extrusion coating, brushing, and spraying.

The afore described various methods and the alternative embodiments may be practiced in any combination thereof.

The methods disclosed herein will now be described in terms of the below example. The example is only included for illustrative purposes and is not meant to limit the invention.

EXAMPLE

A roll of roofing cap sheet surfaced with #11-grade granules (Flintlastic cap sheet commercially available from CertainTeed Corp., Little Rock, Ark.) was coated with 10 wet mils of white coating (CoolStar coating, available also from CertainTeed Corp., Little Rock, Ark.) using a curtain coater equipped with an interrupter cup to produce a 2" uncoated area along the selvage edge. The roll of roofing cap sheet was coated with the white coating in a moving web coater at a conveyer speed of 140 fpm. Four (4) IR heaters installed along a 30' long conveyer were used to cure the coating. Due to surface tension effects, a clearly visible beaded edge along the coated/uncoated line of the coated sheet was formed. See FIG. 6. The beaded edge not only causes a curing issue, but also creates problems for interfering with lapping and with appearance.

Figure 7:
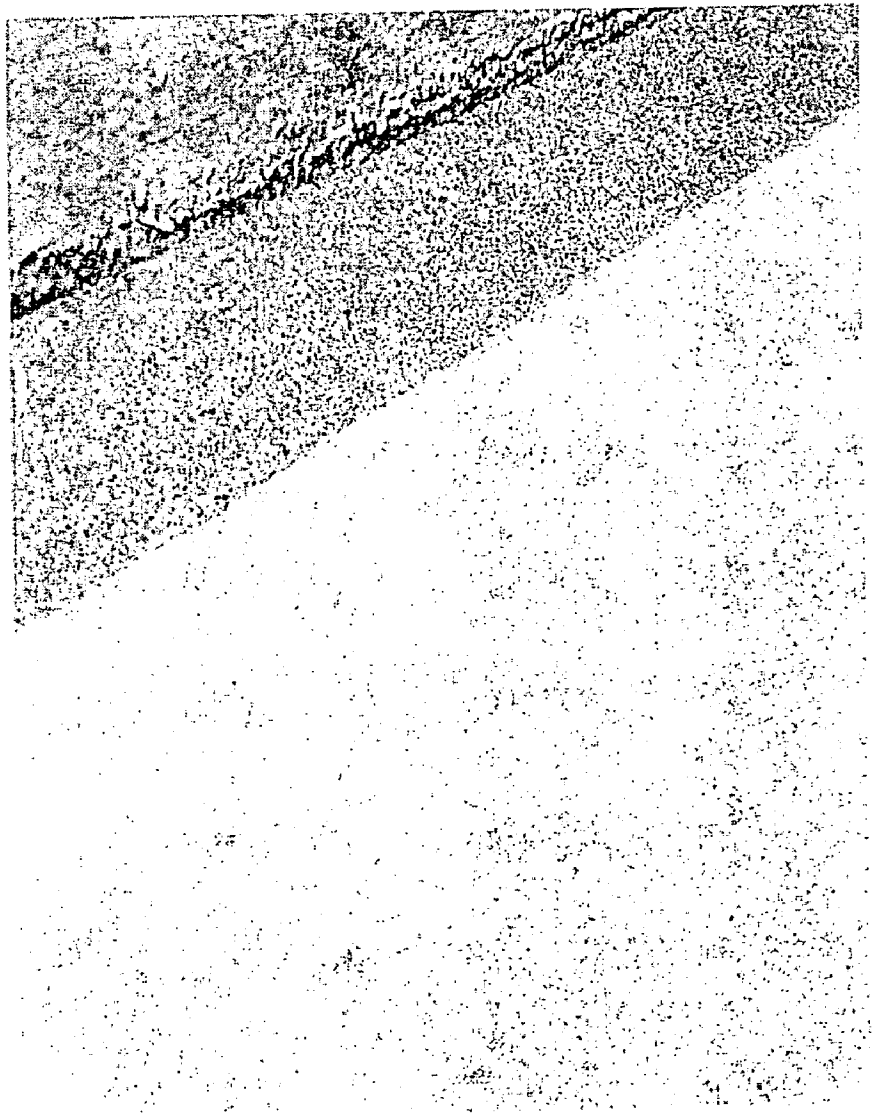
FIG. 7 is a top view of a coated sheet after the sheet has been subjected to the method disclosed herein.

In accordance with the process 10 described above, a non-contact method using a multi-zoned air knife to spread out a beaded edge was installed after the 1$^{st}$ heater. The 1$^{st}$ heater provides a sufficient amount of heat to partially cure the coating to a desirable viscosity. The air flow from the air knife spread the coating back into the coated area and the increase in viscosity as the coating continued to cure and prevented the reformation of the beaded edge. The air flow and the air direction were adjusted such that a smooth, uniform coating along the coated/uncoated edge was achieved (FIG. 7). The setting of the air pressure of each zone and the angle of each zone was individually adjusted to provide the desired coating uniformity.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A method of controlling coating edge thickness in a roofing substrate comprising:

(a) conveying a web of roofing substrate along a longitudinal path in a generally horizontal direction;

(b) applying an adhesive coating to the web of roofing substrate as it moves along its path;

(c) applying surfacing agents in the form of granules to a first surface of the adhesive coated web as the web moves along its path in a generally horizontal direction;

(d) applying a coating to the surfacing agents, thereby forming a film having a cross-machine direction and a longitudinal-machine direction and having one or more uncoated selvage edges;

(e) modifying a thickness of a first portion of the film along one of the edges of the film, thereby forming a film having a substantially predetermined profile in the cross-machine direction; wherein the substantially predetermined profile comprises a substantially uniform thickness.

2. The method of claim 1 wherein the step of clause (b) includes applying a bituminous coating to the web of roofing substrate as the web of roofing substrate moves along its longitudinal path in a generally horizontal direction.

3. The method of claim 1 wherein the substantially predetermined profile comprises the film having one or more segments of thinner thickness than a remainder of the film in the cross-machine direction.

4. The method of claim 1 further comprises partially curing the coating and wherein said modifying includes directing a fluid across at least a segment of a top surface of the film.

5. The method according to claim 4 wherein the fluid is at least one selected from the group of nitrogen, air, helium, argon, neon, krypton, xenon, radon, carbon dioxide, any other gas substantially unreactive with the coating, and combinations thereof.

6. The method of claim 1 further comprising partially curing the coating and wherein said modifying includes applying a negative pressure across at least a segment of a top surface of the film.

7. The method of claim 1 wherein said modifying comprises applying a non-mechanical force to the coating.

8. The method of claim 1 wherein said modifying comprises wicking up at least the first portion of the coating along the at least one edge of the film.

9. The method of claim 8 further comprising applying a solvent to the portion of the coating wicked up.

10. The method of claim 9 further comprising recycling the portion of the coating wicked up.

11. The method of claim 1 wherein said modifying the portion of the coating comprises adjusting a height of the portion of the coating such that the portion of the coating flows toward the center of the film.

12. The method of claim 1 wherein said modifying comprises moving the first portion in the cross-machine direction toward a center of the film.

13. The method of claim 1 wherein said modifying comprises moving the first portion of the coating in the cross-machine direction away from a center of the film.

14. The method of claim 1 further comprising partially curing the coating and wherein said modifying includes applying a positive pressure across at least a segment of a top surface of the film.

15. The method of claim 1 wherein said applying comprises at least one selected from the group of curtain coating, roller coating, brushing, extrusion coating, flow coating, and spraying.

16. The method of claim 1, including:

(a) applying the coating not quite substantially across the width of the substrate, such that the applied coating has a cross-machine direction width smaller than a cross-machine direction width of the substrate; and (b) spreading at least a portion of the applied coating in the cross-machine direction, the longitudinal-machine direction, or a combination thereof, of the coating such that the cross-machine direction of the applied coating comprises a substantially predetermined profile.

17. The method of claim 16 wherein said spreading includes applying a positive pressure to at least the portion of the applied coating.

18. The method of claim 16 wherein said spreading comprises moving the portion of the coating toward a center of the applied coating.

19. The method of claim 16 wherein said spreading comprises moving the portion of the coating away from a center of the applied coating.

20. The method of claim 1:

(a) wherein the step of clause (d) includes applying a polymer to a moving substrate, thereby forming a sheet having a cross-machine direction and a longitudinal-machine direction; and (b) removing a first portion of the polymer from a first edge of the sheet, thereby the sheet having a substantially predetermined profile in the cross-machine direction.

21. The method of claim 20 further comprising partially curing the polymer and wherein said removing includes directing a fluid across at least a segment of a top surface of the sheet.

22. The method of claim 21 further comprising partially curing the polymer and wherein said removing includes applying a negative pressure across at least a segment of a top surface of the sheet.

23. The method of claim 21 wherein said removing comprises wicking up at least the first portion of the polymer along the first edge of the sheet.

24. The process of claim 1, wherein the steps of clauses (d) and (e) are done off-line, subsequent to the steps of clauses (a), (b) and (c).

25. The process of claim 1, wherein the steps of clauses (d) and (e) are done following the step of clause (c), as part of a substantially continuous process.

26. The method of claim 1, including applying a self-adhesive coating to a second surface of the adhesive coated web, which second surface is on the opposite side of the web from the first surface of the web.

27. The method of claim 26, including applying a removable liner to the self-adhesive coating on the second surface of the adhesive coated web.

* * * * *

UNITED STATES PATENT AND TRADEMARK OFFICE

CERTIFICATE OF CORRECTION

PATENT NO. : 7,867,562 B2
APPLICATION NO. : 11/796869
DATED : January 11, 2011
INVENTOR(S) : Ronald S. Wisniewski et al.

It is certified that error appears in the above-identified patent and that said Letters Patent is hereby corrected as shown below:

Column 5 lines 57-58 -- delete "N-methyidithiorcarbamate" insert -- N-methyldithiorcarbamate --

Column 4 line 39 -- delete "after" insert -- latter --

Signed and Sealed this
Twenty-second Day of February, 2011

David J. Kappos

David J. Kappos
*Director of the United States Patent and Trademark Office*